United States Patent [19]

Johnson

[11] 4,339,659

[45] Jul. 13, 1982

[54] IMAGE CONVERTER HAVING SERIAL ARRANGEMENT OF MICROCHANNEL PLATE, INPUT ELECTRODE, PHOSPHOR, AND PHOTOCATHODE

[75] Inventor: Charles B. Johnson, Fort Wayne, Ind.

[73] Assignee: International Telephone and Telegraph Corporation, New York, N.Y.

[21] Appl. No.: 200,161

[22] Filed: Oct. 20, 1980

[51] Int. Cl.[3] ..... H01J 31/50; H01J 40/12

[52] U.S. Cl. ..... 250/213 VT; 313/95; 313/99

[58] Field of Search ..... 313/103 CM, 105 CM, 313/95, 99; 250/213 VT

[56] References Cited

U.S. PATENT DOCUMENTS

| | | | |
|---|---|---|---|
| 2,955,219 | 10/1960 | Niklas | 250/213 VT |
| 3,089,956 | 5/1963 | Harper | 250/213 VT |
| 3,327,151 | 6/1967 | Adams et al. | 250/213 VT |
| 3,617,743 | 11/1971 | Rabatin et al. | 250/483 X |
| 4,051,403 | 9/1977 | Feingold et al. | 313/105 CM |

*Primary Examiner*—Robert Segal

*Attorney, Agent, or Firm*—John T. O'Halloran; Alfred C. Hill

[57] ABSTRACT

Radiant energy images are converted into visual images or video signals by the image converter of the present invention. Input radiant energy images impinge upon a photocathode which is formed on a radiant energy sensitive phosphor that is in turn deposited on the input electrode of a microchannel plate (MCP). A mesh or ring electrode is disposed adjacent the photocathode and biased negative with respect to the MCP input electrode to reflect photoelectrons produced at the photocathode into the MCP. The photoelectrons at the output of the MCP are focused onto a readout device to provide the visual images or video signals. This structure provides high quantum efficiency and improves image quality while retaining relatively high limiting-resolution and high gain.

18 Claims, 2 Drawing Figures

IMAGE CONVERTER HAVING SERIAL ARRANGEMENT OF MICROCHANNEL PLATE, INPUT ELECTRODE, PHOSPHOR, AND PHOTOCATHODE

BACKGROUND OF THE INVENTION

This invention relates to image converters and more particularly to radiant energy image converters employing microchannel plates (MCP).

The term "radiant energy" employed herein includes radiant energy in the X-ray spectral region, the visible spectral region, the ultraviolet spectral region and high energy radiation, such as $\alpha$ particles, $\beta$ particles, $\gamma$ particles and neutrons.

Previously known X-ray image converters employed a phosphor screen/photocathode sandwich upon which the X-rays impinged to produce photoelectrons which were then focused onto an electron target, such as a phosphor screen, an MCP, etc. The disadvantage of this prior image converter is relatively low quantum efficiency and image-quality degrading properties.

SUMMARY OF THE INVENTION

An object of the present invention is to provide a radiant energy image converter that has relatively high quantum efficiency and improved image-quality while retaining relatively high limiting resolution and high gain of MCPs as compared to the previously known radiant energy image converters.

A feature of the present invention is the provision of a radiant energy image converter comprising a vacuum envelope having a longitudinal axis; input means for radiant energy images disposed coaxial of the axis at one end of the envelope; a microchannel plate disposed coaxial of the axis within the envelope in a spaced relationship with the input means, the microchannel plate including an input electrode adjacent to the input means; a radiant energy sensitive phosphor means applied directly to the input electrode; a photocathode applied to the phosphor means; a radiant energy transparent mesh electrode disposed within the envelope coaxial of the axis between the input means and the photocathode; means coupled between the mesh electrode and the input electrode to provide a retarding field therebetween to reflect photoelectrons produced at the photocathode into the plate; a readout means disposed coaxial of the axis at the other end of the envelope; and an electron lens means disposed within the envelope coaxial of the axis between an output of the plate remote from the input means and the readout means to focus photoelectrons emanating from the output of the plate onto the readout means to provide a discernible output related to the radiant energy image.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
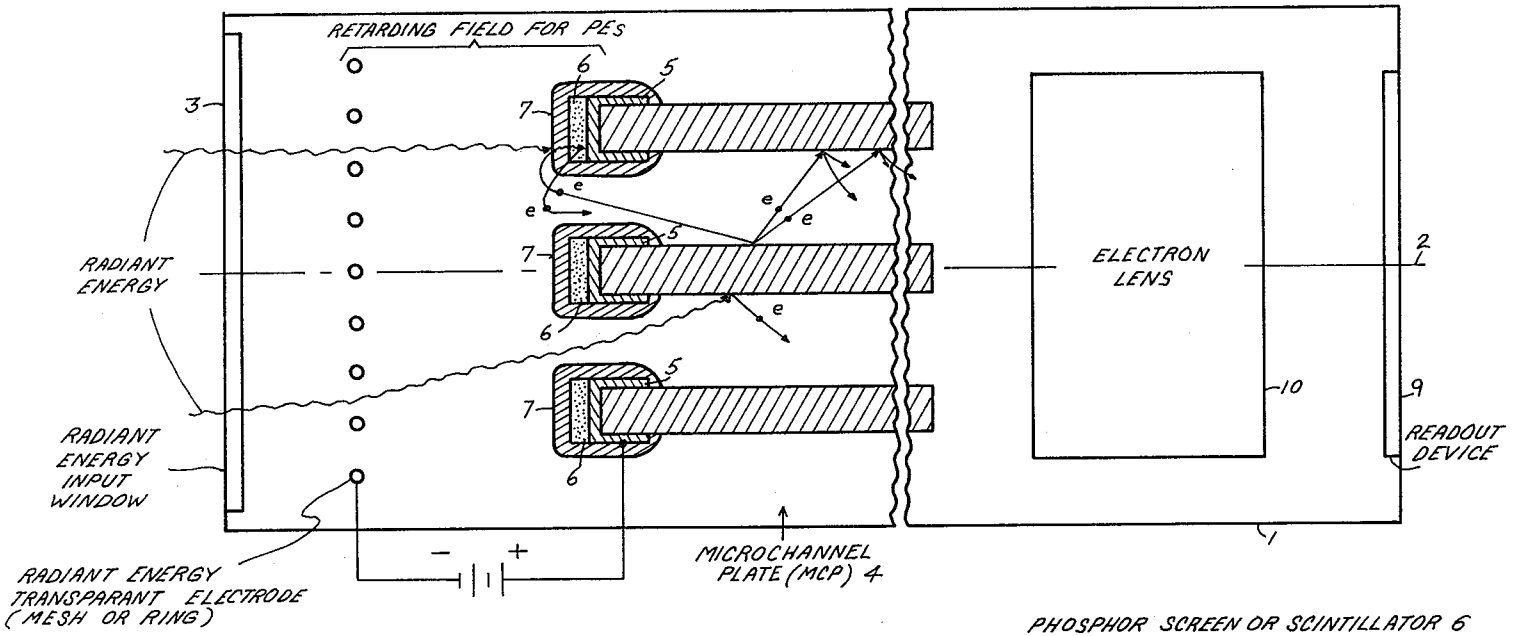
FIG. 1 is a schematic diagram partially in cross-section illustrating the radiant energy image converter in accordance with the principles of the present invention.

Referring to FIG. 1, the image converter includes a vacuum envelope 1 having a longitudinal axis 2. A radiant energy input window 3 is disposed at one end of envelope 1 coaxial of axis 2 having the property of passing radiant energy incident thereon. Input window 3 may be eliminated if the converter of this invention is employed in a vacuum environment such as outer space. An MCP 4 is disposed coaxial of axis 2 within envelope 1 spaced along axis 2 from input window 3. MCP 4 includes on the input end thereof an input electrode 5. A phosphor screen, or scintillator, 6 is applied directly to electrode 5 and a photocathode 7 is applied directly to phosphor screen 6 or applied directly to a protective layer on phosphor screen 6. Intermediate photocathode 7 and input window 3 is disposed a radiant energy transparent mesh or ring electrode 8 disposed within envelope 1 and coaxial of axis 2. A potential is provided between electrode 8 and electrode 5 to provide a retarding field between these two electrodes to reflect photoelectrons produced at photocathode 7 into MCP 4. A readout device 9 is disposed coaxial of axis 2 and at the other end of envelope 1. Readout device 9 may be a phosphor screen for direct viewing, a video camera tube, a gain/storage target of the type used in television camera tubes for video electronic readout/display/-magnetic tape recording, or self-scan array readouts, such as charge coupled devices, charge injection devices and Reticon chips. Alternatively, the output image for MCP 4 may be focused onto a second MCP before readout of the types mentioned above. An electron lens 10 is disposed within envelope 1 coaxial axis 2 between the output of MCP 4 and readout device 9 to focus photoelectrons emanating from the output of MCP 4 onto readout device 9 to provide a discernible output such as a visual image or a video signal which is related to the radiant energy image input.

Figure 2:
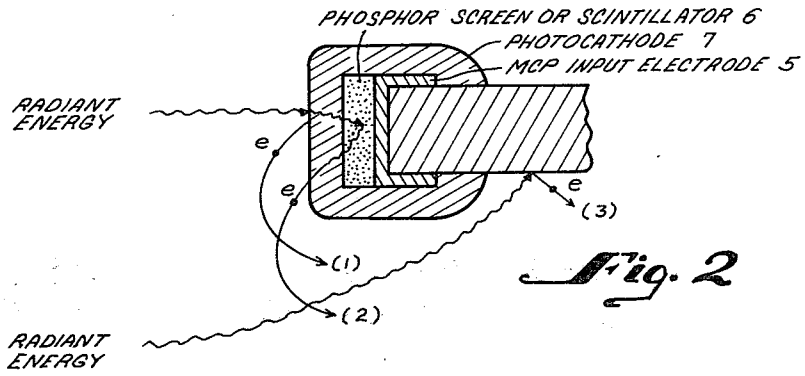
FIG. 2 is an enlarged view of the MCP phosphor screen/photocathode sandwich of FIG. 1 illustrating the conversion of incident radiant energy to photoelectrons in accordance with the principles of the present invention.

The input radiant energy image passes through the radiant energy transparent input window 3 and impinges upon photocathode 7 with certain portions of the input image passing through photocathode 7 and impinging upon phosphor screen 6 and other portions of the image input going directly to MCP 4. The structure employed in the converter of the present invention ensures high quantum efficiency by producing photoelectrons by (1) direct conversion of radiant energy quanta to photoelectrons at photocathode 7, (2) by conversion of radiant quanta which pass through photocathode 7 to light quanta in phosphor screen 6 and the subsequent conversion of these light quanta into photoelectrons in photocathode 7 and (3) by conversion of radiant energy quanta into photoelectrons in MCP 4. The three different photoelectrons that are produced in the converter of the present invention are illustrated in FIG. 2 and identified by (1), (2) and (3) corresponding to the similarly identified conventions above.

High gain is achieved and high resolution is produced by reflecting the photoelectrons produced at photocathode 7 into MCP 4 by electronically biasing mesh electrode 8 negative with respect to input electrode 5. A single MCP provides a useful electrical gain of $10^3$–$10^6$. The photoelectrons at the output of MCP 4 are focused by electron lens 10, which may be a proximity electrostatic or electromagnet electron lens, onto readout device 9.

It has been determined that the image converter of the present invention will operate with the above advantages in various spectral regions provided photocathode 7 and phosphor screen 6 are made of appropriate material. For instance, in the X-ray spectral region, photocathode 7 may be made of cesium antimony and phosphor screen, or scintillator 6 may be composed of cesium iodide. In order to detect $\alpha$, $\beta$ and $\gamma$ particle and neutron radiation, photocathode 7 may be made of cesium antimony and phosphor screen or scintillator, 6 may be made of cesium iodide. In the ultraviolet spectral region, photocathode 7 may be made of a bialkali compound and phosphor screen 7 may be made of sodium iodide. An example of a successfully employed bialkali compound includes cesium, potassium and antimony. In the visible spectral region, photocathode 7 may be made of a multialkali and phosphor screen 6 may be composed of a phosphor compound known as P22R. An example of a successfully employed multialkali includes sodium, potassium, cesium and antimony.

While I have described above the principles of my invention in connection with specific apparatus it is to be clearly understood that this description is made only by way of example and not as a limitation to the scope of my invention as set forth in the objects thereof and in the accompanying claims.

I claim:

1. A radiant energy image converter comprising:
a vacuum envelope having a longitudinal axis;
input means for radiant energy images disposed coaxial of said axis at one end of said envelope;
a microchannel plate disposed coaxial of said axis within said envelope in a spaced relationship with said input means, said plate including an input electrode;
a radiant energy sensitive phosphor means applied directly to said input electrode;
a photocathode applied to said phosphor means;
a radiant energy transparent mesh electrode disposed within said envelope coaxial of said axis between and spaced from said input means and said photocathode;
means coupled between said mesh electrode and said input electrode to provide a retarding field therebetween to reflect photoelectrons produced at said photocathode into said plate;
a readout means disposed coaxially of said axis at the other end of said envelope; and
an electron lens means disposed within said envelope coaxially of said axis between an output of said plate remote from said input means and said readout means to focus photoelectrons emanating from said output of said plate onto said readout means to provide a discernible output related to said radiant image.

2. A converter according to claim 1, wherein
said radiant energy is in the X-ray spectral region.

3. A converter according to claim 2, wherein
said photocathode is composed of cesium antimony, and
said phosphor means is composed of cesium iodide.

4. A converter according to claim 1, wherein
said radiant energy is in the alpha, beta and gamma particle spectral region.

5. A converter according to claim 4, wherein
said photocathode is composed of cesium antimony, and
said phosphor means is composed of cesium iodide.

6. A converter according to claim 1, wherein
said radiant energy is in the neutron spectral regions.

7. A converter according to claim 6, wherein
said photocathode is composed of cesium antimony, and
said phosphor means is composed of cesium iodide.

8. A converter according to claim 1, wherein
said radiant energy includes high energy radiation.

9. A converter according to claim 8, wherein
said photocathode is composed of cesium-antimony, and
said phosphor means is composed of cesium iodide.

10. A converter according to claim 1, wherein
said radiant energy is in the ultraviolet spectral region.

11. A converter according to claim 10, wherein
said photocathode is composed of a bialkali, and
said phosphor means is composed of sodium iodide.

12. A converter according to claim 11, wherein
said bialkali includes cesium, potassium and antimony.

13. A converter according to claim 1, wherein
said radiant energy is in the visible spectral region.

14. A converter according to claim 13, wherein
said photocathode is composed of a multialkali; and
said phosphor means is composed of a phosphorus compound.

15. A converter according to claim 14, wherein
said multialkali includes sodium, potassium, cesium and antimony.

16. A converter according to claim 1, wherein
said input means includes
an input window transparent to said radiant energy images.

17. A converter according to claim 1, wherein said readout means includes
a phosphor screen to provide visual images of said radiant energy images.

18. A converter according to claim 1, wherein said readout means provides video signals related to said radiant energy images.

* * * * *